US012696979B2

(12) United States Patent
Chen

(10) Patent No.: US 12,696,979 B2
(45) Date of Patent: Aug. 4, 2026

(54) COMBINED SOFA

(71) Applicant: SOPHIA & WILLIAM BRANDS CO. LTD, Nanjing (CN)

(72) Inventor: Meidi Chen, Nanjing (CN)

(73) Assignee: SOPHIA & WILLIAM BRANDS CO. LTD, Nanjing (CN)

( * ) Notice: Subject to any disclaimer, the term of this patent is extended or adjusted under 35 U.S.C. 154(b) by 116 days.

(21) Appl. No.: 18/822,318

(22) Filed: Sep. 2, 2024

(65) Prior Publication Data

US 2026/0060426 A1 Mar. 5, 2026

(51) Int. Cl.
*A47C 4/02* (2006.01)
*A47C 7/02* (2006.01)
*A47C 17/02* (2006.01)

(52) U.S. Cl.
CPC ..... *A47C 4/024* (2013.01); *A47C 7/0213* (2018.08); *A47C 17/02* (2013.01)

(58) Field of Classification Search
CPC ..... A47C 4/00; A47C 4/024; A47C 4/025; A47C 4/027; A47C 7/02; A47C 7/0213; A47C 17/02; A47C 17/00
See application file for complete search history.

(56) References Cited

U.S. PATENT DOCUMENTS 6,637,812 B2 * 10/2003 Laughlin ..... A47C 4/028 297/118
8,651,579 B2 * 2/2014 Pettingill ..... A47C 19/027 297/452.56
9,839,295 B2 * 12/2017 Robinson ..... A47C 3/00
11,122,907 B2 * 9/2021 Brandtner ..... A47C 7/30
11,696,644 B2 * 7/2023 Brandtner ..... A47C 31/02 297/440.23
11,793,316 B1 * 10/2023 Jennings ..... A47C 17/134
12,082,705 B2 * 9/2024 Eglinton ..... A47C 13/005
12,318,014 B2 * 6/2025 Caron ..... A47C 7/30
2012/0217784 A1 * 8/2012 Griggs, Jr. ..... A47C 4/028 297/440.1
2015/0305504 A1 * 10/2015 Robinson ..... A47C 7/16 297/452.18
2021/0153658 A1 * 5/2021 Kim ..... A47C 17/04
2024/0148148 A1 * 5/2024 Shao ..... A47C 4/028
2025/0241449 A1 * 7/2025 Zheng ..... A47C 17/161

FOREIGN PATENT DOCUMENTS

CN 204192095 U 3/2015
CN 215604414 U 1/2022
CN 216984249 U 7/2022

* cited by examiner

*Primary Examiner* — Chi Q Nguyen
(74) *Attorney, Agent, or Firm* — Nitin Kaushik

(57) ABSTRACT

A combined sofa, comprising an H-shaped middle frame, where two groups of sofa plate seats are fixedly disposed above two sides of the H-shaped middle frame by bolts; an arc-shaped buckle structure is disposed on a front side edge of the sofa plate seat in a welding manner, and a front support foot is fixedly disposed in the arc-shaped buckle structure through a screw; a middle back frame is fixedly disposed on rear sides of the two groups of sofa plate seats by bolts, and a side back frame is fixedly connected to a rear side corner of the sofa plate seat by bolts. The H-shaped middle frame, the sofa plate seat, the front support foot, the middle back frame, the side back frame, and an arc-shaped handrail are assembled and connected by bolts.

6 Claims, 8 Drawing Sheets

COMBINED SOFA

TECHNICAL FIELD

The present invention relates to the technical field of sofa assemblies, and in particular, to a combined sofa.

BACKGROUND

At present, the back of a bracket-type sofa is not split, which is the whole back of a three-person seat, and a transportation volume is very large, so that a relatively large transport vehicle needs to be used for transportation. A back-top pipe is in a shape of a circular pipe, and at present, the back in the market is connected to an upper surface of the back-top pipe to form a U shape, resulting in a large outer box.

Currently used sofas have the following disadvantages:

1. The sofa is integrally manufactured and has a relatively large trapezoid, which is inconvenient to transport as a whole and has high transportation costs. In addition, once a part is damaged, the whole sofa cannot be used, so that maintenance is not facilitated.
2. There is a lack of a combined cushion structure that is convenient and stable to mount and convenient to disassemble and replace.
3. There is a lack of a backrest structure that is convenient to replace.

SUMMARY

In view of this, the present invention provides a combined sofa, which has a back seat and provides a replaceable backrest structure.

The present invention provides a combined sofa, specifically including an H-shaped middle frame, where two groups of sofa plate seats are fixedly disposed above two sides of the H-shaped middle frame through a bolt; an arc-shaped buckle structure is disposed on a front side edge of the sofa plate seat in a welding manner, and a front support foot is fixedly disposed in the arc-shaped buckle structure through a screw; a middle back frame is fixedly disposed on rear sides of the two groups of sofa plate seats through a bolt, and a side back frame is fixedly connected to a rear side corner of the sofa plate seat through a bolt; and an arc-shaped handrail is fixedly disposed on top portions of the middle back frame and the side back frame through a bolt.

Optionally, two groups of side sofa seats are fixedly disposed on top portions of the sofa plate seats, and a middle sofa seat is fixedly disposed at a position between the two groups of side sofa seats.

Optionally, two groups of locking clamping bases are integrally disposed on middle portions of front and rear sides of a bottom portion of the side sofa seat, and positions below front sides of the locking clamping bases are provided with clamping locking grooves tilting upward; a locking base is disposed between the two groups of locking clamping bases, side locking pins are fixedly disposed on two sides of the two groups of locking clamping bases, and the side locking pins can be disposed in the clamping locking grooves in a matching manner; and a locking screw rod is fixedly disposed on a middle portion of the locking base through threaded connection.

Optionally, front and rear sides of a surface, adjacent to the middle sofa seat, of the side sofa seat are provided with triangular grooves.

Optionally, spring locks that are ejected automatically through springs are disposed at front and rear ends of two sides of the middle sofa seat, two sides of the spring lock are vertical surfaces, and the spring locks can be clamped in the triangular grooves in a matching manner.

Optionally, a middle portion of a front side of the middle sofa seat is provided with a finger groove; and sofa cotton seats are fixedly disposed on top portions of the side sofa seats and the middle sofa seat.

Optionally, three groups of back seats are disposed above the side sofa seats and the middle sofa seat, and buckle rings are fixedly disposed at two ends above a rear side of the back seat.

Optionally, a top portion of the arc-shaped handrail is of an arc-shaped structure, and the buckle ring can be buckled outside the arc-shaped handrail in a matching manner.

Beneficial effects are as follows:

1. In the present invention, the H-shaped middle frame, the sofa plate seat, the front support foot, the middle back frame, the side back frame, and the arc-shaped handrail are assembled and connected through a bolt. An overall sofa framework is split, so that assembly is convenient, and transport space can be greatly reduced, thereby facilitating manual transportation, reducing transportation costs, and facilitating replacement. If damage, deformation, bending, and the like occur on a part, the part can be detached and separately replaced, which is convenient to replace and can be reused.
2. The side sofa seat and the middle sofa seat are disposed, to provide a replaced combined cushion structure. The side sofa seat is fixed by passing through the beam on the middle portion above the sofa plate seat by the locking clamping base, then the locking base is mounted, and the side locking pin is placed in the clamping locking groove, to be fixed through the locking screw rod; and the middle sofa seat is placed between the two groups of side sofa seats and may be fixed by clamping the spring lock into the triangular groove, and fore and aft stress is provided, which may prevent the middle sofa seat from slipping and facilitate disassembly, and when detachment is needed, the finger is inserted into the finger groove to lift up the finger groove.
3. The back seat is disposed, to provide a replaceable backrest structure, and the back seat is mounted and is fixed and mounted by attaching the buckle ring to the arc-shaped handrail. Different types of sofa cotton pads such as a pure cotton pad or a summer sleeping mat pad may be disposed in front of the back seat, to be adapted to flexible replacement and use in different seasons.

Figure 1:
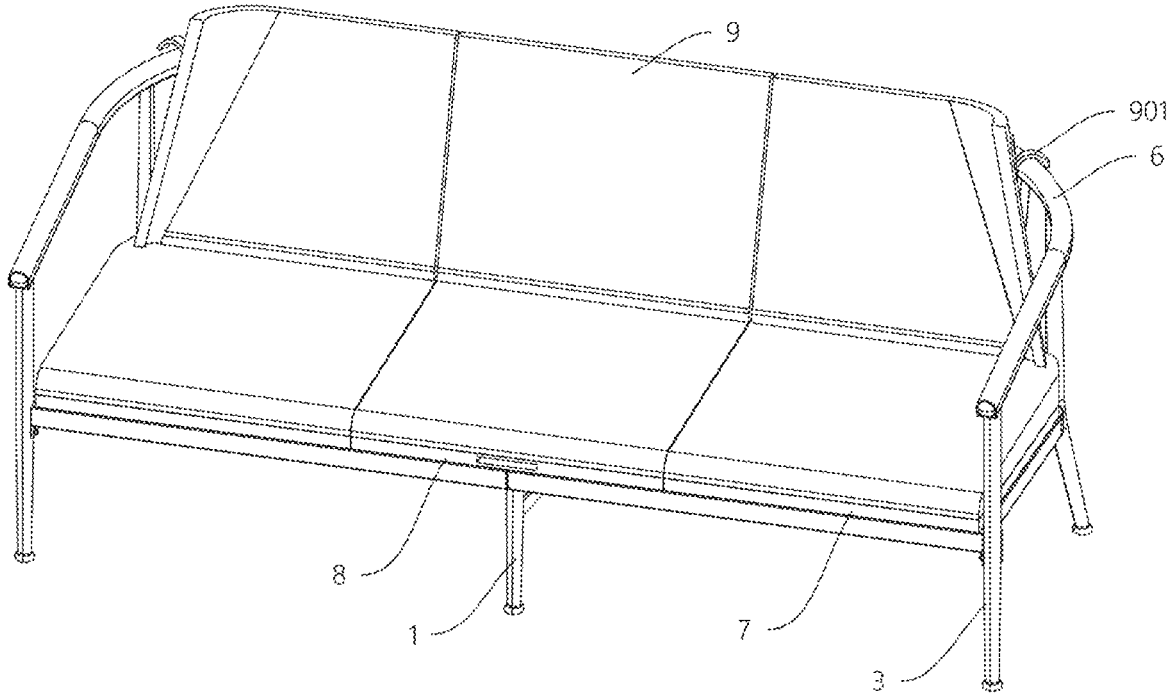
FIG. 1 is an overall schematic structural diagram according to an embodiment of the present invention.

Reference numerals in the accompanying drawings:

1. H-shaped middle frame; 2. sofa plate seat; 21. arc-shaped buckle structure 3. front support foot; 4. middle back frame; 5. side back frame; 6. arc-shaped handrail; 7. side sofa seat; 701. locking clamping base; 702. clamping locking groove; 703. locking base; 704. side locking pin; 705. locking screw rod; 706. triangular groove; 8. middle sofa seat; 801. spring lock; 802. finger groove; 9. back seat; 901. buckle ring.

DETAILED DESCRIPTION OF THE EMBODIMENTS

To make the objectives, solutions, and advantages of the technical solutions of the present invention clearer, the following clearly and completely describes the technical solutions in the embodiments of the present invention with reference to the accompanying drawings in the specific embodiments of the present invention.

Embodiment 1

Figure 2:
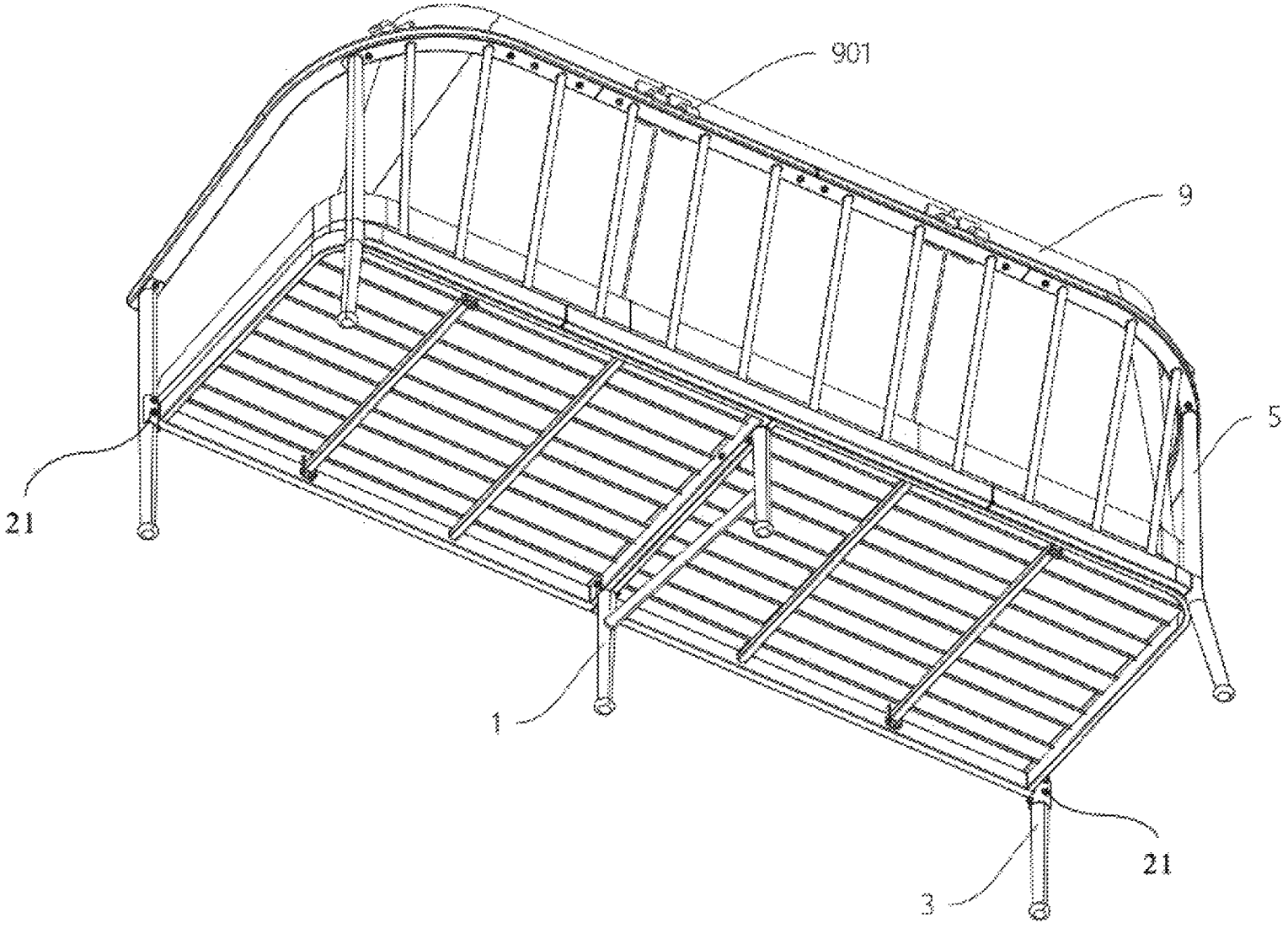
FIG. 2 is a schematic structural side bottom view according to an embodiment of the present invention.
Figure 3:
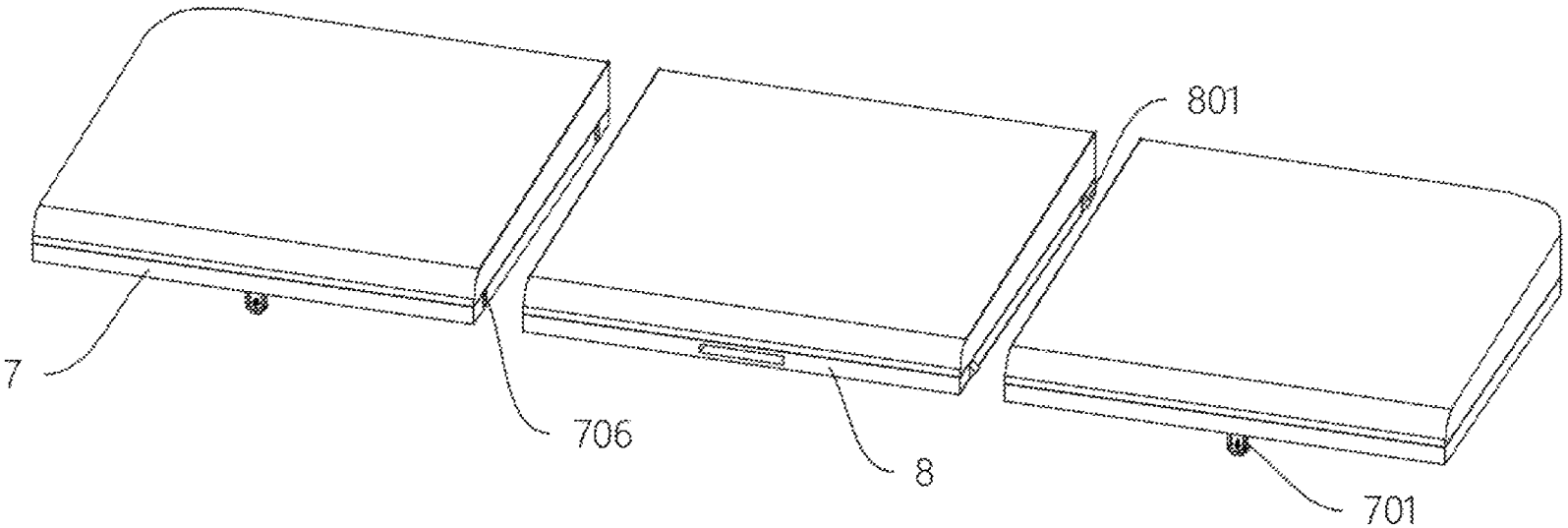
FIG. 3 is a schematic structural diagram of assembly of a side sofa seat according to an embodiment of the present invention.
Figure 4:
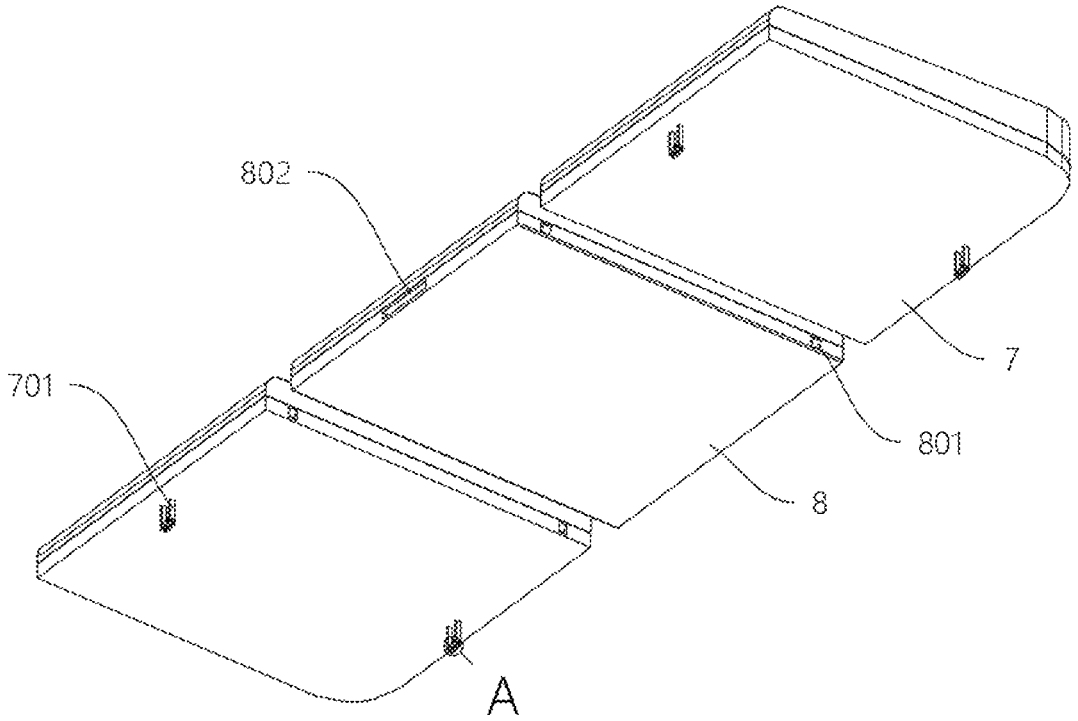
FIG. 4 is a schematic structural side bottom view of FIG. 3 according to an embodiment of the present invention.
Figure 5:
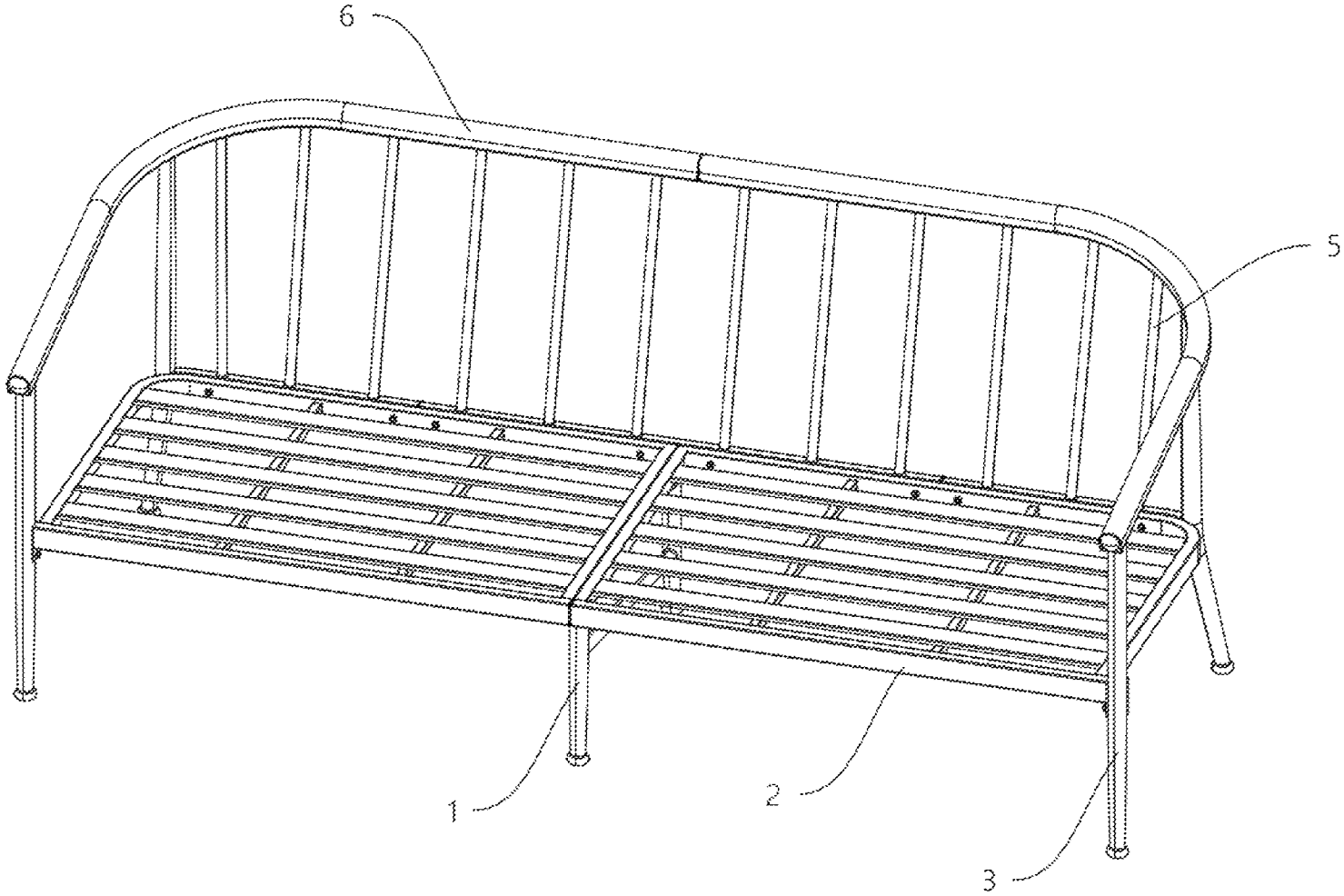
FIG. 5 is a schematic structural diagram of assembly according to an embodiment of the present invention.
Figure 6:
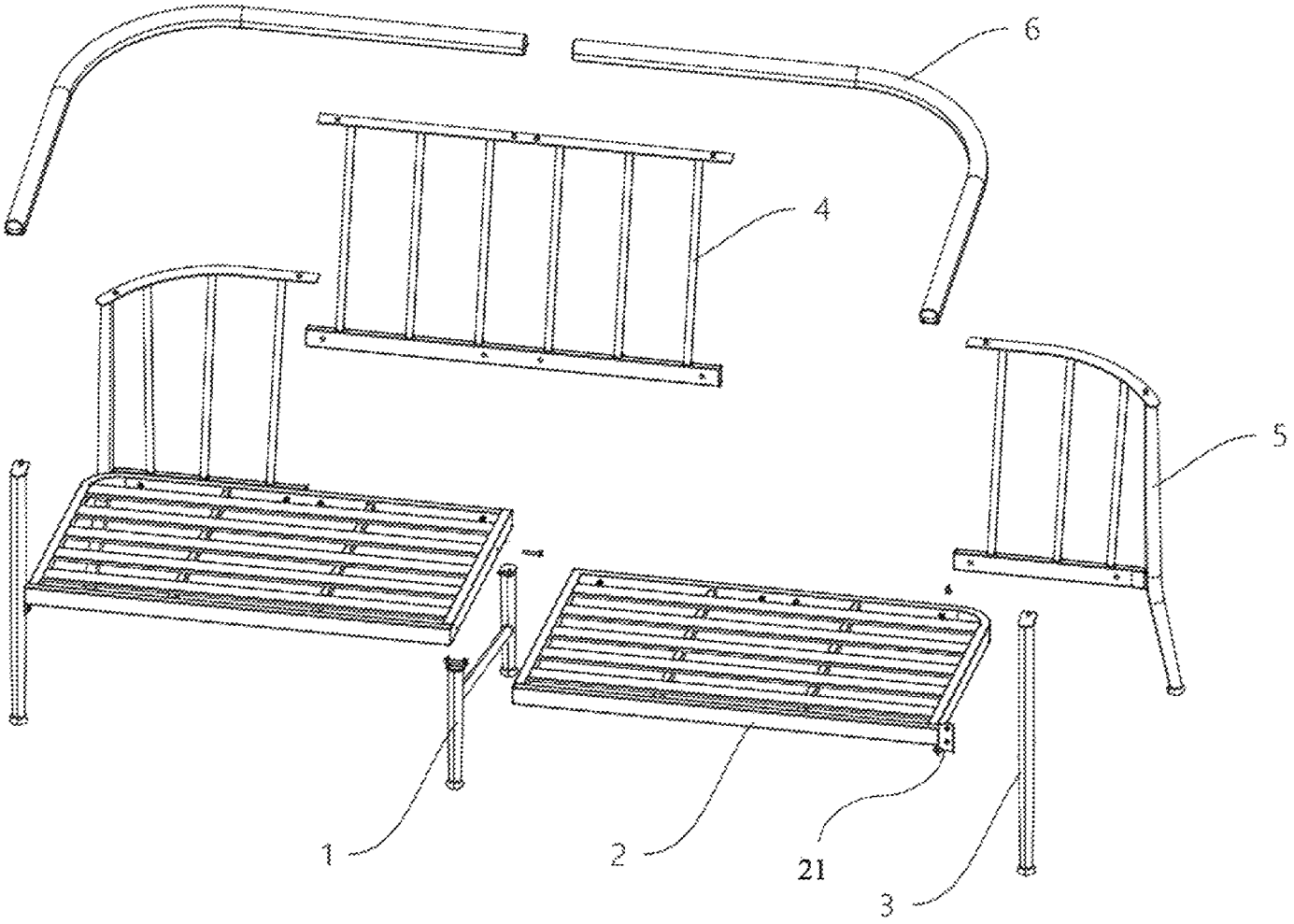
FIG. 6 is a schematic structural exploded view according to an embodiment of the present invention.
Figure 7:
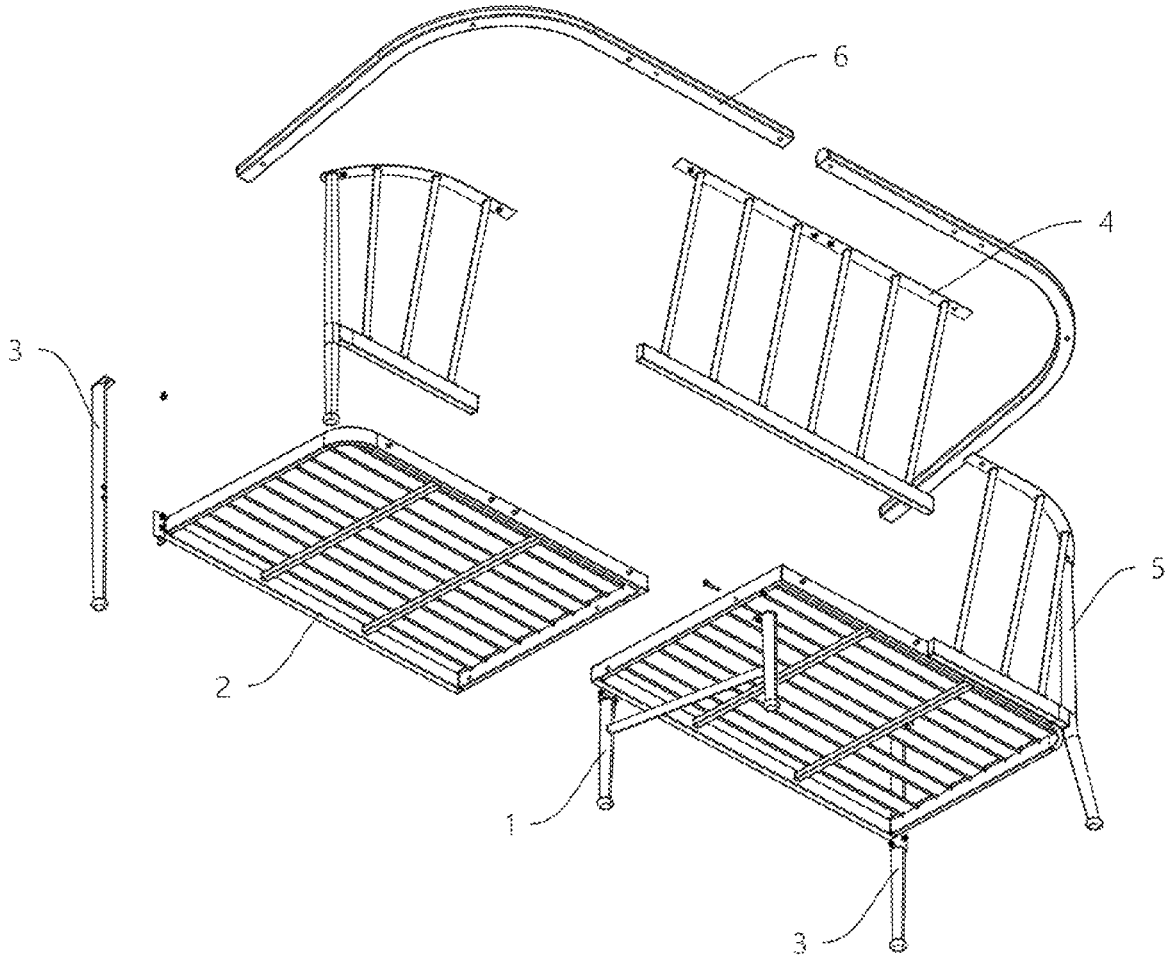
FIG. 7 is a schematic structural side bottom view of FIG. 6 according to an embodiment of the present invention.
Figure 8:
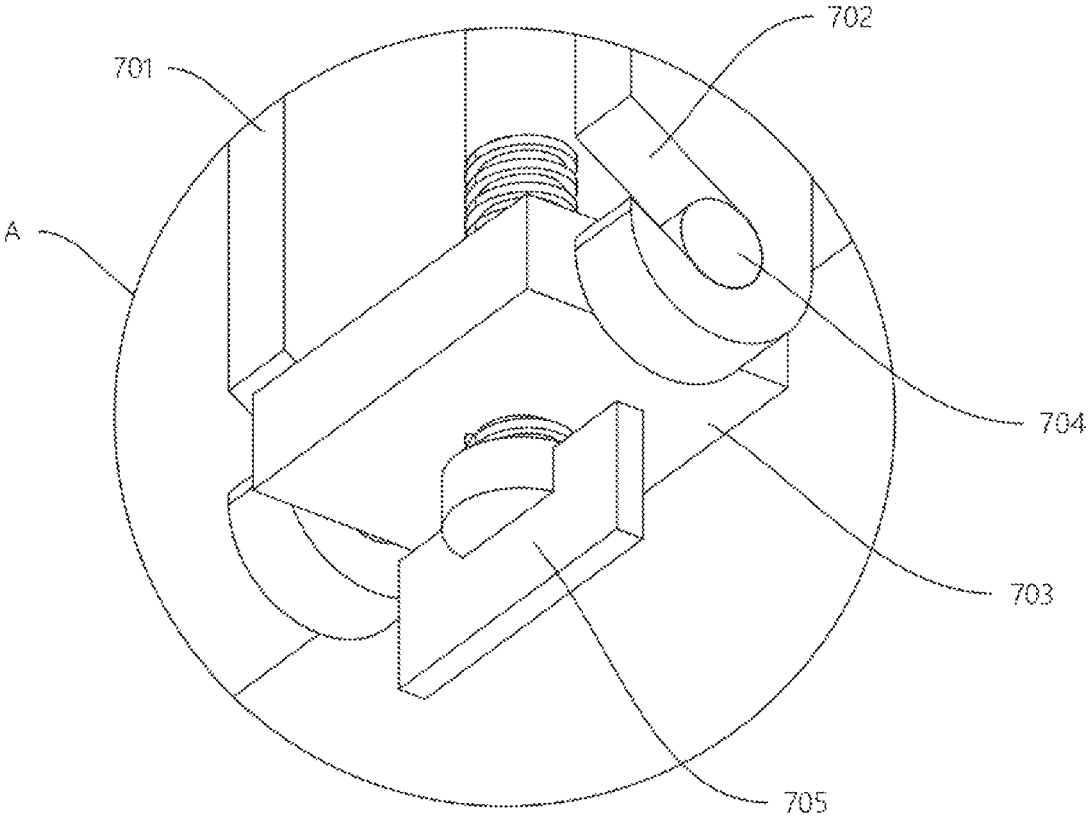
FIG. 8 is a schematic structural partial enlargement view of a position A according to an embodiment of the present invention.

Referring to FIG. 1 to FIG. 8 in the accompanying drawings of the specification:

The present invention provides a combined sofa, including an H-shaped middle frame 1, where two groups of sofa plate seats 2 are fixedly disposed above two sides of the H-shaped middle frame 1 through a bolt; an arc-shaped buckle structure 21 is disposed on a front side edge of the sofa plate seat 2 in a welding manner, and a front support foot 3 is fixedly disposed in the arc-shaped buckle structure 21 through a screw; a middle back frame 4 is fixedly disposed on rear sides of the two groups of sofa plate seats 2 through a bolt, and a side back frame 5 is fixedly connected to a rear side corner of the sofa plate seat 2 through a bolt; and an arc-shaped handrail 6 is fixedly disposed on top portions of the middle back frame 4 and the side back frame 5 through a bolt.

Two groups of side sofa seats 7 are fixedly disposed on top portions of the sofa plate seats 2, and a middle sofa seat 8 is fixedly disposed at a position between the two groups of side sofa seats 7.

Two groups of locking clamping bases 701 are integrally disposed on middle portions of front and rear sides of a bottom portion of the side sofa seat 7, and positions below front sides of the locking clamping bases 701 are provided with clamping locking grooves 702 tilting upward; a locking base 703 is disposed between the two groups of locking clamping bases 701, side locking pins 704 are fixedly disposed on two sides of the two groups of locking clamping bases 701, and the side locking pins 704 can be disposed in the clamping locking grooves 702 in a matching manner; and a locking screw rod 705 is fixedly disposed on a middle portion of the locking base 703 through threaded connection.

Front and rear sides of a surface, adjacent to the middle sofa seat 8, of the side sofa seat 7 are provided with triangular grooves 706.

Spring locks 801 that are ejected automatically through springs are disposed at front and rear ends of two sides of the middle sofa seat 8, two sides of the spring lock 801 are vertical surfaces, and the spring locks 801 can be clamped in the triangular grooves 706 in a matching manner.

A middle portion of a front side of the middle sofa seat 8 is provided with a finger groove 802; and sofa cotton seats are fixedly disposed on top portions of the side sofa seats 7 and the middle sofa seat 8.

Three groups of back seats 9 are disposed above the side sofa seats 7 and the middle sofa seat 8, and buckle rings 901 are fixedly disposed at two ends above a rear side of the back seat 9.

A top portion of the arc-shaped handrail 6 is of an arc-shaped structure, and the buckle ring 901 can be buckled outside the arc-shaped handrail 6 in a matching manner.

As shown in FIG. 1 to FIG. 8, during mounting, the H-shaped middle frame 1 is placed on the ground, and then the two groups of sofa plate seats 2 are fixedly disposed above the two sides of the H-shaped middle frame 1 through the bolt; the arc-shaped buckle structure 21 is disposed on the front side edge of the sofa plate seat 2 in a welding manner, and the front support foot 3 is fixedly disposed in the arc-shaped buckle structure 21 through the screw; the middle back frame 4 is fixedly disposed on the rear side of the two groups of sofa plate seats 2 through the bolt, and two groups of side back frames 5 are fixedly disposed on two sides of the middle back frame 4 through the bolt; and four groups of rear support feet on rear sides of bottom portions of the side back frames 5 are aligned with the front support foot 3.

The side back frames 5 are fixedly connected to the rear side corners of the sofa plate seats 2 through the bolt.

The arc-shaped handrails 6 are fixedly disposed on the top portions of the middle back frame 4 and the side back frames 5 through the bolt.

Embodiment 2

Based on Embodiment 1, the two groups of side sofa seats 7 are mounted on edge side positions above the two groups of sofa plate seats 2 and are fixed by passing through beams on middle portions above the sofa plate seats 2 by the locking clamping bases 701, then the locking base 703 is mounted, the side locking pins 704 are placed in the clamping locking grooves 702, and the locking screw rod 705 is rotated to perform locking and fixing. Then the middle sofa seat 8 is mounted, the middle sofa seat 8 is placed between the two groups of side sofa seats 7, and the spring locks 801 are clamped in the triangular grooves 706 to perform self-locking and fixing and provide fore and aft stress, to prevent the middle sofa seat 8 from slipping.

When detachment is needed, a finger is inserted into the finger groove 802 to lift up the finger groove 802.

Embodiment 3

Based on Embodiment 1, the back seat 9 is mounted and is fixed and mounted by attaching the buckle ring 901 to the arc-shaped handrail 6, and different types of sofa cotton pads such as a pure cotton pad or a summer sleeping mat pad may be disposed in front of the back seat 9, to be adapted to flexible replacement and use in different seasons.

Specific use manners and effects of the embodiment: in the present invention, an assembly manner is that: the H-shaped middle frame 1 is placed on the ground, and then the two groups of sofa plate seats 2 are fixedly disposed above the two sides of the H-shaped middle frame 1 through the bolt;

the arc-shaped buckle structure 21 is disposed on the front side edge of the sofa plate seat 2 in a welding manner, and the front support foot 3 is fixedly disposed in the arc-shaped buckle structure 21 through the screw;

the middle back frame 4 is fixedly disposed on the rear side of the two groups of sofa plate seats 2 through the bolt, and two groups of side back frames 5 are fixedly disposed on two sides of the middle back frame 4 through the bolt; and four groups of rear support feet on rear sides of bottom portions of the side back frames 5 are aligned with the front support foot 3;

the side back frames 5 are fixedly connected to the rear side corners of the sofa plate seats 2 through the bolt;

the arc-shaped handrails 6 are fixedly disposed on the top portions of the middle back frame 4 and the side back frames 5 through the bolt;

after complete mounting is implemented, the two groups of side sofa seats 7 are mounted on edge side positions above the two groups of sofa plate seats 2 and are fixed by passing through beams on middle portions above the sofa plate seats 2 by the locking clamping bases 701, then the locking base 703 is mounted, the side locking pins 704 are placed in the clamping locking grooves 702, and the locking screw rod 705 is rotated to perform locking and fixing;

then the middle sofa seat 8 is mounted, the middle sofa seat 8 is placed between the two groups of side sofa seats 7, and the spring locks 801 are clamped in the triangular grooves 706 to perform self-locking and fixing and provide fore and aft stress, to prevent the middle sofa seat 8 from slipping; and when detachment is needed, a finger is inserted into the finger groove 802 to lift up the finger groove 802; and then the back seat 9 is disposed and is fixed and mounted by attaching the buckle ring 901 to the arc-shaped handrail 6.

What is claimed is:

1. A combined sofa, comprising an H-shaped middle frame (1), wherein two groups of sofa plate seats (2) are fixedly disposed above two sides of the H-shaped middle frame (1) by bolts; an arc-shaped buckle structure is disposed on a front side edge of the sofa plate seat (2) in a welding manner, and a front support foot (3) is fixedly disposed in the arc-shaped buckle structure through a screw; a middle back frame (4) is fixedly disposed on rear sides of the two groups of sofa plate seats (2) by bolts, and a side back frame (5) is fixedly connected to a rear side corner of the sofa plate seat (2) by bolts; and an arc-shaped handrail (6) is fixedly disposed on top portions of the middle back frame (4) and the side back frame (5) by bolts, wherein two groups of side sofa seats (7) are fixedly disposed on top portions of the sofa plate seats (2), and a middle sofa seat (8) is fixedly disposed at a position between the two groups of side sofa seats (7), wherein two groups of locking clamping bases (701) are integrally disposed on middle portions of front and rear sides of a bottom portion of the side sofa seat (7), and positions below front sides of the locking clamping bases (701) are provided with clamping locking grooves (702) tilting upward; a locking base (703) is disposed between the two groups of locking clamping bases (701), side locking pins (704) are fixedly disposed on two sides of the two groups of locking clamping bases (701), and the side locking pins (704) can be disposed in the clamping locking grooves (702) in a matching manner; and a locking screw rod (705) is fixedly disposed on a middle portion of the locking base (703) through threaded connection.

2. The combined sofa according to claim 1, wherein front and rear sides of a surface, adjacent to the middle sofa seat (8), of the side sofa seat (7) are provided with triangular grooves (706).

3. The combined sofa according to claim 2, wherein spring locks (801) that are ejected automatically through springs are disposed at front and rear ends of two sides of the middle sofa seat (8), two sides of the spring lock (801) are vertical surfaces, and the spring locks (801) can be clamped in the triangular grooves (706) in a matching manner.

4. The combined sofa according to claim 3, wherein a middle portion of a front side of the middle sofa seat (8) is provided with a finger groove (802); and sofa cotton seats are fixedly disposed on top portions of the side sofa seats (7) and the middle sofa seat (8).

5. The combined sofa according to claim 4, wherein three groups of back seats (9) are disposed above the side sofa seats (7) and the middle sofa seat (8), and buckle rings (901) are fixedly disposed at two ends above a rear side of the back seat (9).

6. The combined sofa according to claim 5, wherein a top portion of the arc-shaped handrail (6) is of an arc-shaped structure, and the buckle ring (901) can be buckled outside the arc-shaped handrail (6) in a matching manner.

* * * * *